US007867958B2

(12) United States Patent
Jao et al.

(10) Patent No.: US 7,867,958 B2
(45) **Date of Patent: *Jan. 11, 2011**

(54) DIBLOCK MONOPOLYMERS AS LUBRICANT ADDITIVES AND LUBRICANT FORMULATIONS CONTAINING SAME

(75) Inventors: Tze-Chi Jao, Glen Allen, VA (US); Mark T. Devlin, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 1065 days.

This patent is subject to a terminal disclaimer.

(21) Appl. No.: 11/608,866

(22) Filed: Dec. 11, 2006

(65) Prior Publication Data

US 2007/0254820 A1 Nov. 1, 2007

(51) Int. Cl.
*C10M 145/14* (2006.01)

(52) U.S. Cl. ..... 508/469

(58) Field of Classification Search ..... 508/469
See application file for complete search history.

(56) References Cited

U.S. PATENT DOCUMENTS

| | | | |
|---|---|---|---|
| 2,384,577 | A | 9/1945 | Thomas |
| 2,710,872 | A | 6/1955 | Thompson |
| 2,786,866 | A | 3/1957 | Hook et al. |
| 2,897,152 | A | 7/1959 | Elliot et al. |
| 3,219,666 | A | 11/1965 | Norman et al. |
| 3,356,702 | A | 12/1967 | Farmer et al. |
| 3,407,222 | A | 10/1968 | Lies |
| 3,509,051 | A | 4/1970 | Farmer et al. |
| 3,565,804 | A | 2/1971 | Honnen et al. |
| 3,697,574 | A | 10/1972 | Piasek et al. |
| 3,736,357 | A | 5/1973 | Piasek et al. |
| 3,794,081 | A | 2/1974 | Fiser et al. |
| 3,816,314 | A | 6/1974 | Pappas et al. |
| 3,867,359 | A | 2/1975 | Beadle |
| 4,029,587 | A | 6/1977 | Koch |
| 4,098,705 | A | 7/1978 | Sakurai et al. |
| 4,164,473 | A | 8/1979 | Coupland et al. |

(Continued)

FOREIGN PATENT DOCUMENTS

| | | |
|---|---|---|
| CA | 2392727 | 6/2001 |

(Continued)

OTHER PUBLICATIONS

Zheng, R. et al: Polymer Nano- and Microspheres with Bumpy and Chain-Segregated Surfaces. In J. Am. Chem. Soc., 2005, 127, pp. 15358-15359.

(Continued)

*Primary Examiner*—Ellen M McAvoy
*Assistant Examiner*—Taiwo Oladapo
(74) *Attorney, Agent, or Firm*—Luedeka, Neely & Graham, P.C.

(57) ABSTRACT

A method for reducing friction coefficients and wear between lubricated surfaces. The method includes providing an amount of an oil-soluble or oil-dispersible component selected from the group consisting of a photo-crosslinkable poly(2-cinnamoyloxyalkyl acrylate) core and a diblock acrylate copolymer corona in a fully formulated lubricant composition containing a base oil of lubricating viscosity. The lubricant composition containing the component is applied to a surface to be lubricated.

52 Claims, 1 Drawing Sheet

U.S. PATENT DOCUMENTS

| | | | |
|---|---|---|---|
| 4,178,258 | A | 12/1979 | Papay et al. |
| 4,234,435 | A | 11/1980 | Meinhardt et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | deVries et al. |
| 4,266,945 | A | 5/1981 | Karn |
| 4,272,387 | A | 6/1981 | King et al. |
| 4,283,295 | A | 8/1981 | deVries et al. |
| 4,285,822 | A | 8/1981 | deVries et al. |
| 4,362,633 | A | 12/1982 | Spence et al. |
| 4,369,119 | A | 1/1983 | deVries et al. |
| 4,395,343 | A | 7/1983 | deVries et al. |
| 4,402,840 | A | 9/1983 | deVries et al. |
| 4,466,901 | A | 8/1984 | Hunt et al. |
| 4,636,322 | A | 1/1987 | Nalesnik |
| 4,692,256 | A | 9/1987 | Umemura et al. |
| 4,758,362 | A | 7/1988 | Butke |
| 4,765,918 | A | 8/1988 | Love et al. |
| 4,867,890 | A | 9/1989 | Colclough et al. |
| 4,876,375 | A | 10/1989 | Lam |
| 4,885,365 | A | 12/1989 | Lam |
| 4,889,647 | A | 12/1989 | Rowan et al. |
| 4,904,401 | A | 2/1990 | Ripple et al. |
| 4,927,552 | A | 5/1990 | Lam |
| 4,957,643 | A | 9/1990 | Lam |
| 4,957,649 | A | 9/1990 | Ripple et al. |
| 4,966,719 | A | 10/1990 | Coyle et al. |
| 4,978,464 | A | 12/1990 | Coyle et al. |
| 4,990,271 | A | 2/1991 | Francis |
| 4,995,996 | A | 2/1991 | Coyle et al. |
| 5,011,504 | A | 4/1991 | Henry et al. |
| 5,137,647 | A | 8/1992 | Karol |
| 5,204,012 | A | 4/1993 | Schaffhausen |
| 5,412,130 | A | 5/1995 | Karol |
| 5,627,259 | A | 5/1997 | Thaler et al. |
| 5,633,326 | A | 5/1997 | Patil et al. |
| 5,643,859 | A | 7/1997 | Gutierrez et al. |
| 5,686,397 | A | 11/1997 | Baranski et al. |
| 5,693,598 | A | 12/1997 | Abraham et al. |
| 5,789,357 | A | 8/1998 | Baranski et al. |
| 5,792,729 | A | 8/1998 | Harrison et al. |
| 5,851,965 | A | 12/1998 | Harrison et al. |
| 5,853,434 | A | 12/1998 | Harrison et al. |
| 5,902,776 | A | 5/1999 | Dohner et al. |
| 5,936,041 | A | 8/1999 | Diana et al. |
| 6,034,040 | A | 3/2000 | Ozbalik et al. |
| 6,114,288 | A | 9/2000 | Fujitsu et al. |
| 6,117,826 | A | 9/2000 | Baranski et al. |
| 6,232,276 | B1 | 5/2001 | Stiefel et al. |
| 6,509,303 | B1 | 1/2003 | Gatto |
| 6,528,463 | B1 | 3/2003 | Gatto et al. |
| 6,723,685 | B2 | 4/2004 | Hartley et al. |
| 6,797,677 | B2 | 9/2004 | Esche, Jr. et al. |
| 6,872,785 | B2 | 3/2005 | Wang et al. |
| 7,632,788 | B2 * | 12/2009 | Jao et al. ..... 508/410 |
| 2004/0266630 | A1 | 12/2004 | George et al. |
| 2005/0119134 | A1 | 6/2005 | Tequi et al. |
| 2005/0197443 | A1 | 9/2005 | Ziser et al. |
| 2006/0189490 | A1 | 8/2006 | Dardin |
| 2006/0252858 | A1 | 11/2006 | Obrecht et al. |
| 2006/0275690 | A1 | 12/2006 | Fessenbecker et al. |
| 2006/0275691 | A1 | 12/2006 | Fessenbecker et al. |
| 2007/0135317 | A1 | 6/2007 | Jao et al. |
| 2008/0064768 | A1 | 3/2008 | Ziser et al. |
| 2008/0280793 | A1 | 11/2008 | Tequi et al. |

FOREIGN PATENT DOCUMENTS

| | | |
|---|---|---|
| DE | 19934182 | 1/2001 |
| DE | 10314776 | 10/2004 |
| EP | 0265254 | 4/1988 |
| EP | 330522 B1 | 8/1989 |
| GB | 2329905 | 4/1999 |
| JP | 2000247935 | 9/2000 |
| JP | 2004256414 | 9/2004 |
| JP | 2005041934 | 2/2005 |
| WO | 0140339 | 6/2001 |
| WO | 2005056739 | 6/2005 |
| WO | 2007068102 | 6/2007 |

OTHER PUBLICATIONS

Liu, G. et al: End Coupling of Block Copolymer Nanotubes to Nanospheres. In J. Am. Chem. Soc., 2003, 125 pp. 14039-14045.

Hu. J. et al: Chain Mixing and Segregation in B-C and C-D Diblock Copolymer Micelles. In Macromolecules, 2005, 38, 8058-8065.

* cited by examiner

DIBLOCK MONOPOLYMERS AS LUBRICANT ADDITIVES AND LUBRICANT FORMULATIONS CONTAINING SAME

TECHNICAL FIELD

The embodiments described herein relate to methods for friction modification and wear reduction using fully formulated lubricants containing diblock monopolymers. In particular, oil-soluble components are useful in lubricant formulations to reduce friction coefficients thereof and as wear reducing agents therefor.

BACKGROUND AND SUMMARY

A lubricant may be a liquid, a paste, or a solid with liquid lubricants being the most used. Lubricating oils may be used in automobile engines, transmissions, bearings, gears, industrial gears and other machinery to reduce friction and wear and to increase fuel economy. A number of components including, but not limited to dispersants, detergents, friction modifiers, antiwear agents, antioxidants, and anti-corrosion additives are typically present in fully formulated lubricating oils. For many lubricant applications, a viscosity index improver may also be included as a major component.

With the energy resources depleting and more stringent environmental regulations being adopted, there exists a greater demand to increase a fuel economy of vehicles and to decrease emissions in vehicle exhausts. Currently, organic friction modifiers are added to the lubricating oils to increase fuel economy. However, the level of the fuel economy achievable by organic friction modifiers is limited. Hence, there is a need for alternate methods for achieving improvements in fuel economy.

One method for increasing fuel economy is to provide lower viscosity grade lubricating oils. While providing lower viscosity lubricating oils may dramatically increase fuel economy, such lubricating oils may also increase wear. Wear may be partially reduced by using antiwear agents such as zinc dialkyldithiolphosphate (ZDTP). However, ZDTP contains phosphorus and its decomposition products may have deleterious effects on automotive catalyst systems for emission control. Accordingly, there remains an increasing need for methods for reducing friction and wear without adversely affecting emission control systems and without further depleting scarce natural resources.

SUMMARY OF THE EMBODIMENTS

With regard to the above, exemplary embodiments described herein provide methods for reducing friction coefficients and wear between lubricated surfaces. The method includes providing an amount of at least one oil-soluble or oil-dispersible component selected from a photo-crosslinkable poly(2-cinnamoyloxyalkyl acrylate) core and/or a diblock acrylate copolymer corona in a fully formulated lubricant composition containing a base oil of lubricating viscosity. According to the method, the lubricant composition containing the component is applied to a surface to be lubricated.

Thus one object of this invention is to disclose a discovery that the lubricant performance in friction and wear reduction can be achieved by incorporating the precursors of oil-soluble nanoparticles as an additive component into a lubricant. The precursors are diblock monopolymers, of which one of the blocks is a photocrosslinkable poly[(2-cinnamoyloxylethyl acrylate or poly[2-cinnamoyloxylethyl acrylate)-ran-(2-octtanoyloxyethyl acrylate)] and a second block is an oil-soluble block. Such diblock precursor polymers can form micelles in a base oil. These precursors are also referred to herein as "components". A simple blend of each such precursor or component in an EHC-45 base oil has shown that the precursors have a friction reduction capability better than that of the conventional friction modifier, such as GMO (glycerol monooleate).

The present disclosure provides in another embodiment the incorporation of the precursors (diblock polymers) of oil-soluble nanoparticles into lubricants or fuels. The precursors themselves are oil-soluble and impart friction modification and wear reduction to the lubricating oil. The class of lubricants that can utilize this type of additive technology includes engine oil, gear oil, automatic transmission fluids, manual transmission fluids, hydraulic fluids, metalworking fluids, and industrial oil. The benefits offered by this invention are three-fold: friction and wear reduction, solubility in oil, and no necessity to crosslink. Thus the present disclosure provides in one embodiment the use of a precursor or component to impart friction modification or wear reduction to a lubricating oil selected from the group consisting of engine oil, gear oil, automatic transmission fluids, hydraulic oil, metalworking fluids, and industrial oil.

The precursors (components) can also provide friction modification, also known as lubricity, in fuels such as low sulfur and ultra low sulfur diesel fuels.

The present disclosure provides a fuel composition comprising (a) a fuel selected from the group consisting of gasoline, diesel, and biodiesel fuels, and (b) a component selected from the group consisting of a photo-crosslinkable poly(2-cinnamoyloxyalkyl acrylate) core and a diblock acrylate copolymer corona. The present disclosure also provides a fuel composition comprising (a) a fuel selected from the group consisting of gasoline, diesel, and biodiesel fuels, and (b) a component selected from the group consisting of a photo-crosslinkable poly(2-cinnamoyloxyalkyl acrylate) core and a diblock acrylate copolymer corona.

Oil-soluble diblocks polymers here can in one embodiment contain two blocks. One block is photocrosslinkable and may benefit from solubilization by the addition of or association with a hydrocarbyl group, and the other block is an oil-soluble moiety. When they are combined through a synthetic chemical reaction, the whole polymer molecule is rendered soluble or at least dispersible in oil. The diblock polymers before photocrosslinking can form micelles in oil.

In another embodiment, there is provided a method of reducing a friction coefficient of an engine lubricant composition during operation of an engine containing the lubricant composition. The method includes contacting the engine parts with a fully formulated lubricant composition having a base oil of lubricating viscosity and an amount of an oil-soluble component derived from a photo-crosslinkable poly (2-cinnamoyloxyalkyl acrylate) core and/or a diblock acrylate copolymer corona sufficient to reduce the friction coefficient to below a friction coefficient of a lubricant composition devoid of the oil-soluble component. The component can, in one embodiment, have a core diameter ranging from about 10 to about 100 nanometers.

A further embodiment of the disclosure provides a method for reducing wear between moving parts using a lubricating oil. The method includes using as the lubricating oil for one or more moving parts a lubricant composition containing a base oil, and an oil additive package including a wear reducing agent. The wear reducing agent is an oil-soluble component derived from a photo-crosslinkable poly(2-cinnamoyloxyalkyl acrylate) core and/or a diblock acrylate copolymer corona.

A further embodiment of the disclosure provides a method for reducing a friction coefficient adjacent a lubricated surface, comprising providing an amount of an oil-soluble component derived from a photo-crosslinkable poly(2-cinnamoyloxyalkyl acrylate) core and/or a diblock acrylate copolymer corona in a fully formulated lubricant composition containing a base oil of lubricating viscosity, and applying the lubricant composition containing the component to a surface to be lubricated. In one embodiment, the component has a core diameter greater than the film thickness of the lubricant composition.

A further embodiment of the disclosure provides a method of reducing a friction coefficient of an engine lubricant composition during operation of an engine containing the lubricant composition, comprising contacting the engine parts with a fully formulated lubricant composition comprising a base oil of lubricating viscosity and an amount of an oil-soluble component derived from a photo-crosslinkable poly (2-cinnamoyloxyalkyl acrylate) core and/or a diblock acrylate copolymer corona sufficient to reduce the friction coefficient to below a friction coefficient of a lubricant composition devoid of the oil-soluble component, wherein the component has a core diameter greater than the film thickness of the lubricant composition.

As set forth briefly above, embodiments of the disclosure provide unique finished lubricant and/or fuel compositions that may significantly improve the coefficient of friction of the lubricant and/or fuel composition and may reduce wear for relatively low viscosity lubricant compositions. An additive package containing the oil-soluble component may be mixed with an oleaginous fluid that is applied to a surface between moving parts. In other applications, an additive package containing the oil-soluble component may be provided in a fully formulated lubricant composition.

The methods described herein are particularly suitable for reducing contamination of pollution control devices on motor vehicles or, in the alternative, the compositions are suitable for improving the friction coefficient characteristics and wear properties of lubricant formulations. Unlike fullerenes and inorganic nanoparticles, the components described herein enable better particle size and shape control, which may be beneficial for enhancing lubricant effectiveness. Other features and advantages of the methods described herein may be evident by reference to the following detailed description which is intended to exemplify aspects of the exemplary embodiments without intending to limit the embodiments described herein.

It is to be understood that both the foregoing general description and the following detailed description are exemplary and explanatory only and are intended to provide further explanation of the embodiments disclosed aid claimed.

BRIEF DESCRIPTION OF THE DRAWINGS

Further advantages of the embodiments will become apparent by reference to the detailed description of preferred embodiments when considered in conjunction with the drawings, wherein like reference characters designate like or similar elements throughout the several drawings as follows.

DETAILED DESCRIPTION OF EMBODIMENTS

Figure 1:
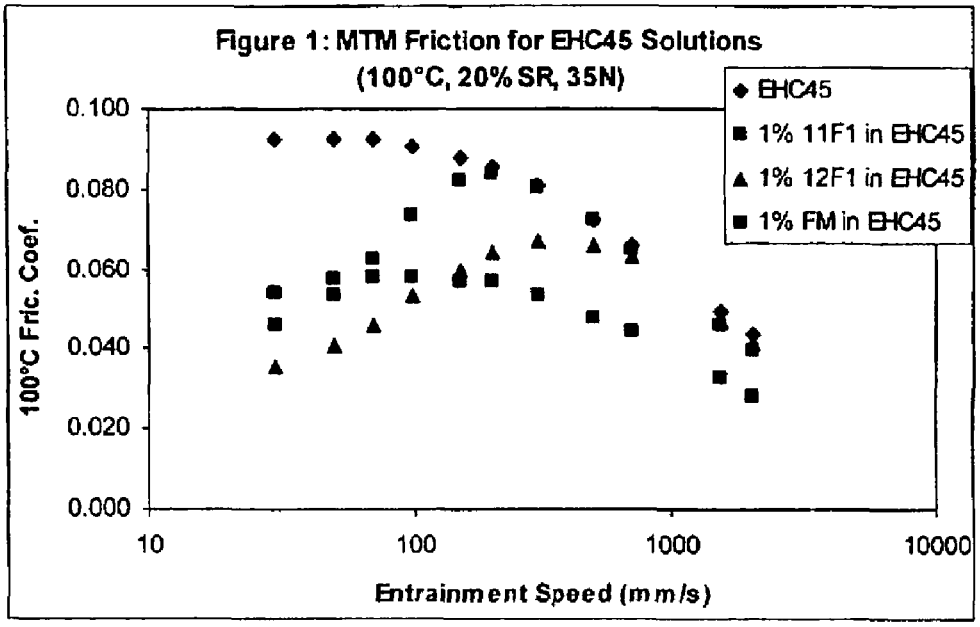
FIG. 1 is a graph of data showing oil-soluble diblock polymer is capable of reducing friction and wear better than the conventional friction modifiers, such as GMO (glycerol monooelate) in a MTM rig.
Figure 2:
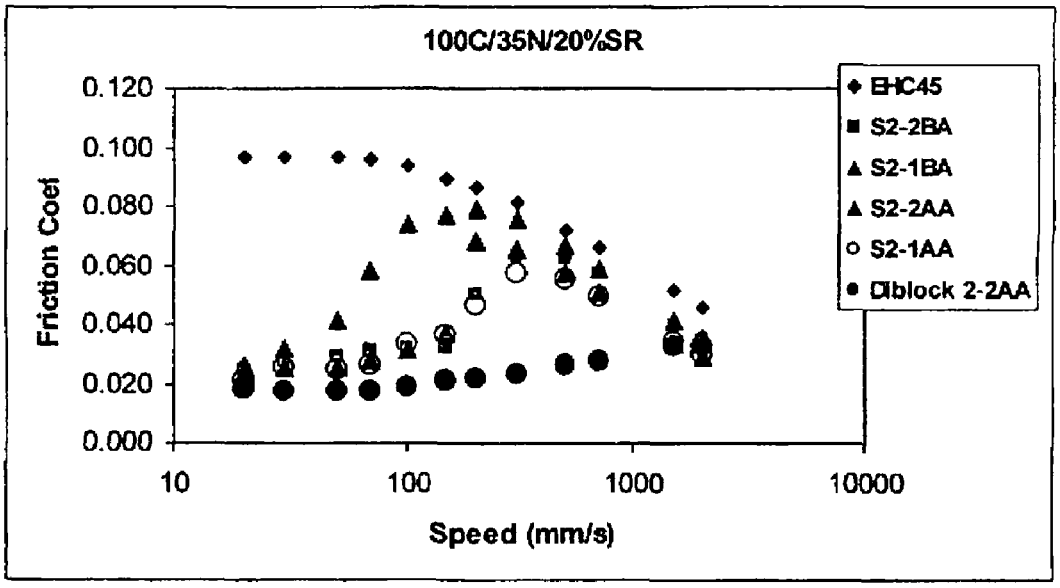
FIG. 2 is a graph showing the inventive component has a lower coefficient of friction.

For the purposes of this disclosure, the terms "hydrocarbon soluble," "oil soluble," or "dispersable" are not intended to indicate that the compounds are soluble, dissolvable, miscible, or capable of being suspended in a hydrocarbon compound or oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

As used herein, "hydrocarbon" means any of a vast number of compounds containing carbon, hydrogen, and/or oxygen in various combinations. The term "hydrocarbyl" refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The component useful herein can include a substantially oil-insoluble core and an oil-soluble corona attached to the core. The core of the component is derived from a photo-crosslinkable poly(2-cinnamoyloxyalkyl acrylate) or PCAA block made by reacting hydroxyl groups of poly(hydroxylalkyl acrylate) or PHAA with cinnamoyl chloride. The glass transition temperature of the core 12 may be adjusted by reacting a fraction of the hydroxyalkyl acrylate with octanoyl chloride to provide poly[(2 -cinnamoyloxyalkyl acrylate)-ran-(2-octanoyloxyalkyl acrylate)] or such as poly[(2 -cinnamoyloxyethyl acrylate)-ran-(2-octanoyloxyethyl acrylate)] or P(CEA-r -OEA) illustrated by the following formula:

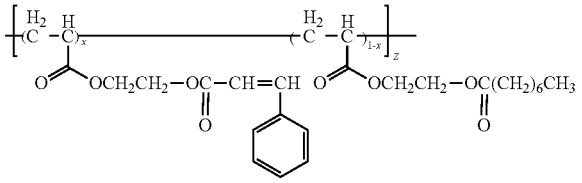

wherein x ranges from about 0.1 to about 1.0 and z ranges from about 20 to about 500. A core diameter (CD) may be selected by changing the molar mass of the diblock and will typically have a diameter ranging from about 10 to about 50 nanometers.

An oil-soluble block copolymer is provided, for example, as the corona surrounding the core. Accordingly, a suitable block copolymer may be derived from poly[(2-ethylalkyl acrylate)-ran-(alkyl acrylate)]-block-poly(2-hydroxyalkyl acrylate) such as poly[(2-ethylhexyl acrylate)-ran-(tert-butyl acrylate)]-block-poly(2-hydroxyethyl acrylate) or P(EXA-r-tBA)-b-PHEA illustrated by the following formula:

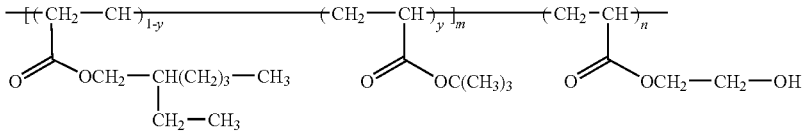

wherein y ranges from about 0.001 to about 0.5, m ranges from about 20 to about 500 and n ranges from about 20 to about 500. The corona noticeably increases the hydrodynamic diameter (HD) of the component so that the overall average diameter ranges from about 20 to about 100 nanometers.

The P(EXA-r-tBA) block was chosen to provide the corona for the component due to its solubility in lubricating base oils, which consist mostly of paraffins, aromatics and naphthenes (cycloparaffins). However, other solubilizing hydrocarbons can also be employed in the present invention to improve the solubility of the component in lubricating base oils. A small mole fraction y of tBA, e.g. less than 1.5%, may incorporated into the block copolymer for the corona so that the tBA may be selectively hydrolyzed to yield acrylic acid or AA groups to facilitate component adsorption on the surfaces of metals or other substrates. The PHEA block, for example, was chosen for its easy derivatisation. The hydroxyl groups of PHEA may be reacted with cinnamoyl chloride to yield a photocrosslinkable poly(2-cinnamoyloxyethyl acrylate) or PCEA block. The glass transition temperature of the derivatised PHEA block may be adjusted by reacting a fraction of the HEA hydroxyl groups with octanoyl chloride to yield poly ((2-cinnamoyloxyethyl acrylate)-ran-(2-octanoyloxyethyl acrylate)) or P(CEA-r-OEA).

The component of the present invention may be prepared in hexane or tetrahydrofuran/hexane with a high content of hexane, which is believed to be a block-selective solvent for the P(EXA-r-tBA) block. In such a block-selective solvent, the insoluble PCEA or P(CEA-r-OEA) block may form the core of either spherical or cylindrical aggregates, depending on the n/m value of the diblock and the solvent. The soluble P(EXA-r-tBA) block provides the corona. The core of such aggregate may be crosslinked photochemically to lock in the structure to provide substantially permanent friction modifying or wear reducing components.

EXAMPLE 1

P(EXA-r-tBA)-b-PHEA Synthesis

The base set of polymers P(EXA-r-tBA)-b-PHEA providing the corona may be prepared by hydrolyzing P(EXA-r-tBA)-b-P(HEA-TMS), where P(HEA-TMS) denotes poly(2-trimethylsilyloxyethyl acrylate). P(EXA-r-tBA)-b-P(HEA-TMS) may be synthesized by an atom transfer radical polymerization (ATRP) process for making PBA-b-(P(HEA-TMS), where PBA denotes poly(butyl acrylate). The initiating system includes methyl 2-bromopropionate ($CH_3CHBrCO_2CH_3$), copper(I) bromide and N, N, N', N'', N''-pentamethyldiethylenetriamine (PMDETA) of the formula $((CH_3)_2NCH_2CH_2)_2NCH_3$.

P(EXA-r-tBA)-b-P(HEA-TMS) may be prepared by copolymerizing EXA and a small amount tBA in a nonpolar solvent such as toluene. The mole fraction of tBA in the feed ratio should be less than 1.5%. After purification of the first block, the first block may be used as a macroinitiator to polymerize the second monomer, trimethylsilyloxyethyl acrylate or HEA-TMS. The TMS groups may be removed by hydrolysis in aqueous THF by adding drops of acetic acid.

EXAMPLE 2

P(EXA-r-tBA)-b-PCEA Synthesis

The P(EXA-r-tBA)-b-PHEA made according to Example 1 may be reacted with cinnamoyl chloride in pyridine to provide P(EXA-r-tBA)-b-PCEA. PCEA is desirable for its photocrosslinkability of the friction modifying or wear reducing component of the present invention. In order to lower the glass transition temperature $T_g$ of the core-forming block copolymer, a portion of the hydroxyl groups may in one embodiment be reacted with octanoyl chloride before reacting with an excess of cinnamoyl chloride to yield P(EXA-r-tBA)-b-P(CEA-r-OEA). The CEA molar fraction in the block copolymer is desirably no lower than 50% to facilitate effective core crosslinking.

While not desiring to be bound by theory, it is believed that lubricating oils achieve lubrication primarily by two mechanisms. Based on the law of fluid dynamics, a hydrodynamic pressure pushing two sliding surfaces apart is the highest in regions where the two surfaces are the closest. The pressure supports the load and avoids the direct contact of the sliding surfaces in the hydrodynamic lubrication (HDL) regime. In a high load and/or low speed situation, a lubricant system enters a mixed lubrication (ML) or a boundary lubrication (BL) regime and the asperities of the surfaces are inevitably in partial or extensive contact. A lubricant containing amphiphilic molecules avoids the direct contact of the asperities by forming a film on the surfaces. The adsorbed films reduce friction because they are more readily sheared off from a surface that is metal and can reform on the metal surfaces after the moving parts move away from one another. Also the adsorbed films normally repel one another as has been demonstrated for polymer brushes formed on sliding mica surfaces.

It is expected the foregoing block copolymer components may function as friction modifiers and/or antiwear agents by one or more of the following mechanisms: a) physical separation of the sliding surfaces by the components, b) conversion of sliding friction between the sliding surfaces to a rolling friction between the surfaces and components, and c) coating of the adjacent surfaces by the components or fragments of the components. Unlike fullerenes or inorganic nanoparticles, the components of the present invention may enable wider particle size and shape control.

The oil-soluble components described above are advantageously incorporated into lubricating compositions. Accordingly, the oil-soluble components may be added directly to a finished lubricating oil composition. In one embodiment, however, the oil-soluble component is diluted with a substantially inert, normally liquid organic diluent such as mineral oil, synthetic oil (e.g., ester of dicarboxylic acid), naptha, alkylated (e.g., $C_{10}$-$C_{13}$ alkyl) benzene, toluene or xylene to form an additive concentrate. The additive concentrates may contain from about 0% to about 99% by weight diluent oil and the oil-soluble component.

In the preparation of lubricating oil formulations it is common practice to introduce the additive concentrate in the form of 1 to 99 wt. % active ingredients concentrates in hydrocarbon oil, e.g. mineral lubricating oil, or other suitable solvent. Usually these concentrates may be added to a lubricating oil with a dispersant/inhibitor (DI) additive package and viscosity index (VI) improvers containing 0.01 to 50 parts by weight of lubricating oil per part by weight of the DI package to form finished lubricants, e.g. crankcase motor oils. Suitable DI packages are described for example in U.S. Pat. Nos. 5,204,012 and 6,034,040 for example. Among the types of additives included in the DI additive package are detergents, dispersants, antiwear agents, friction modifiers, seal swell agents, antioxidants, foam inhibitors, lubricity agents, rust inhibitors, corrosion inhibitors, demulsifiers, viscosity index improvers, and the like. Several of these components are well known to those skilled in the art and are used in conventional amounts with the additives and compositions described herein.

Lubricant compositions made with the components described above are used in a wide variety of applications. For compression ignition engines and spark ignition engines, it is preferred that the lubricant compositions meet or exceed published API -CI-4 or GF-4 standards. Lubricant compositions according to the foregoing API-CI-4 or GF-4 standards include a base oil, the DI additive package, and/or a VI improver to provide a fully formulated lubricant. The base oil for lubricants according to the disclosure is an oil of lubricating viscosity selected from natural lubricating oils, synthetic lubricating oils and mixtures thereof. Such base oils include those conventionally employed as crankcase lubricating oils for spark-ignited and compression-ignited internal combustion engines, such as automobile and truck engines, marine and railroad diesel engines, and the like.

The components described above may be used in fully formulated automatic transmission fluids, fully formulated crankcase fluids, fully formulated heavy duty gear fluids, and the like. Such components may be effective to reduce friction coefficient and wear.

The components may in one embodiment be present in a lubricating composition in an amount of up to about 5 wt % of the fully formulated lubricant composition. As another example, the components may be present in an amount of about 0.1 to about 5 wt % in a fully formulated lubricant composition. As an even further example, the components may be present in an amount of about 0.5 to about 2 wt % in a fully formulated lubricant composition.

Suitable components may in one embodiment have a core diameter of from about 10 to about 100 nm and a hydrodynamic diameter of from about 10 to about 120 nm. Other embodiments might utilize larger or smaller components.

Dispersant Components

Dispersants contained in the DI package include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

Oxidation Inhibitor Components

Oxidation inhibitors or antioxidants reduce the tendency of base stocks to deteriorate in service which deterioration can be evidenced by the products of oxidation such as sludge and varnish-like deposits that deposit on metal surfaces and by viscosity growth of the finished lubricant. Such oxidation inhibitors include hindered phenols, sulfurized hindered phenols, alkaline earth metal salts of alkylphenolthioesters having $C_5$ to $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used include sterically hindered phenols and diarylamines, alkylated phenothiazines, sulfurized compounds, and ashless dialkyldithiocarbamates. Non-limiting examples of sterically hindered phenols include, but are not limited to, 2,6-di-tertiary butylphenol, 2,6 di-tertiary butyl methylphenol, 4-ethyl-2,6-di-tertiary butylphenol, 4-propyl-2,6-di-tertiary butylphenol, 4-butyl-2,6-di-tertiary butylphenol, 4-pentyl-2,6-di-tertiary butylphenol, 4-hexyl-2,6-di-tertiary butylphenol, 4-heptyl-2,6-di-tertiary butylphenol, 4-(2-ethylhexyl)-2,6-di-tertiary butylphenol, 4-octyl-2,6-di-tertiary butylphenol, 4-nonyl-2,6-di-tertiary butylphenol, 4-decyl-2,6-di-tertiary butylphenol, 4-undecyl-2,6-di-tertiary butylphenol, 4-dodecyl-2,6-di-tertiary butylphenol, methylene bridged sterically hindered phenols including but not limited to 4,4-methylenebis(6-tert-butyl-o-cresol), 4,4-methylenebis(2-tert-amyl-o-cresol), 2,2-methylenebis(4-methyl-6 tert-butylphenol, 4,4-methylenebis(2,6-di-tert-butylphenol) and mixtures thereof as described in U.S. Publication No. 2004/0266630.

Diarylamine antioxidants include, but are not limited to diarylamines having the formula:

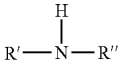

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is desirable that one or both aryl groups be substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus the diarylamine may contain at least two nitrogen atoms wherein at least one nitrogen atom has two aryl groups attached thereto, e.g. as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenylamine; dibutyldiphenylamine; monooctyidiphenyl amine; dioctyidiphenylamine; monononyidiphenylamine; dinonyidiphenylamine; monotetradecyidiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyldiphenylamine; p-oriented styrenated diphenylamine; mixed butyloctyldiphenylamine; and mixed octylstyryidiphenylamine.

Another class of aminic antioxidants includes phenothiazine or alkylated phenothiazine having the chemical formula:

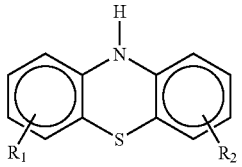

wherein $R_1$ is a linear or branched $C_1$ to $C_{24}$ alkyl, aryl, heteroalkyl or alkylaryl group and $R_2$ is hydrogen or a linear or branched $C_1$-$C_{24}$ alkyl, heteroalkyl, or alkylaryl group. Alkylated phenothiazine may be selected from the group consisting of monotetradecylphenothiazine, ditetradecylphenothiazine, monodecylphenothiazine, didecylphenothiazine, monononylphenothiazine, dinonylphenothiazine, monoctylphenothiazine, dioctylphenothiazine, monobutylphenothiazine, dibutylphenothiazine, monostyrylphenothiazine, distyrylphenothiazine, butyloctylphenothiazine, and styryloctylphenothiazine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soyabean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing 20 weight % sulfur, when added to the finished lubricant at a 1.0 weight % treat level, will deliver 2000 ppm of sulfur to the finished lubricant. A sulfurized fatty oil or olefin containing 10 weight % sulfur, when added to the finished lubricant at a 1.0 weight % treat level, will deliver 1000 ppm sulfur to the finished lubricant. It is desirable to add the sulfurized olefin or sulfurized fatty oil to deliver between 200 ppm and 2000 ppm sulfur to the finished lubricant. The foregoing aminic, phenothiazine, and sulfur containing antioxidants are described for example in U.S. Pat. No. 6,599,865.

The ashless dialkyldithiocarbamates which may be used as antioxidant additives include compounds that are soluble or dispersable in the additive package. It is also desired that the ashless dialkyldithiocarbamate be of low volatility, with a molecular weight greater than 250 daltons, desirably, a molecular weight greater than 400 daltons. Examples of ashless dithiocarbamates that may be used include, but are not limited to, methylenebis(dialkyldithiocarbamate), ethylenebis(dialkyldithiocarbamate), isobutyl disulfide-2,2'-bis (dialkyldithiocarbamate), hydroxyalkyl substituted dialkyldithio-carbamates, dithiocarbamates prepared from unsaturated compounds, dithiocarbamates prepared from norbornylene, and dithiocarbamates prepared from epoxides, where the alkyl groups of the dialkyldithiocarbamate can preferably have from 1 to 16 carbons. Examples of dialkyldithiocarbamates that may be used are disclosed in the following patents: U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Examples of ashless dithiocarbamates are: Methylenebis (dibutyidithiocarbamate), Ethylenebis(dibutyidithiocarbamate), Isobutyl disulfide-2,2'-bis(dibutyidithiocarbamate), Dibutyl-N,N-dibutyl-(dithiocarbamyl)succinate, 2-hydroxypropyl dibutyldithiocarbamate, Butyl(dibutyldithiocarbamyl)acetate, and S-carbomethoxy-ethyl-N,N-dibutyl dithiocarbamate. The most desirable ashless dithiocarbamate is methylenebis(dibutyldithiocarbamate).

Zinc dialkyl dithiophosphates ("Zn DDPs") may also be used in lubricating oils in addition to the components. Zn DDPs have good antiwear and antioxidant properties and have been used to pass cam wear tests, such as the Seq. IVA and TU3 Wear Test. Many patents address the manufacture and use of Zn DDPs including U.S. Pat. Nos. 4,904,401; 4,957,649; and 6,114,288. Non-limiting general Zn DDP types are primary, secondary and mixtures of primary and secondary Zn DDPs Likewise, organomolybdenum containing compounds used as friction modifiers may also exhibit antioxidant functionality. U.S. Pat. No. 6,797,677 describes a combination of organomolybdenum compound, alkylphenothizine and alkyldiphenylamines for use in finished lubricant formulations. Examples of suitable molybdenum containing friction modifiers are described below under friction modifiers.

The friction modifying and wear reducing components described herein may be used with any or all of the foregoing antioxidants in any and all combinations and ratios. It is understood that various combinations of phenolic, aminic, sulfur containing and molybdenum containing additives may be optimized for the finished lubricant formulation based on bench or engine tests or modifications of the dispersant, VI improver, base oil, or any other additive.

Friction Modifier Components

A sulfur- and phosphorus-free organomolybdenum compound that may be used as an additional friction modifier may be prepared by reacting a sulfur- and phosphorus-free molybdenum source with an organic compound containing amino and/or alcohol groups. Examples of sulfur- and phosphorus-free molybdenum sources include molybdenum trioxide, ammonium molybdate, sodium molybdate and potassium molybdate. The amino groups may be monoamines, diamines, or polyamines. The alcohol groups may be monosubstituted alcohols, diols or bis-alcohols, or polyalcohols. As an example, the reaction of diamines with fatty oils produces a product containing both amino and alcohol groups that can react with the sulfur- and phosphorus-free molybdenum source.

Examples of sulfur- and phosphorus-free organomolybdenum compounds include the following:

1. Compounds prepared by reacting certain basic nitrogen compounds with a molybdenum source as described in U.S. Pat. Nos. 4,259,195 and 4,261,843.

2. Compounds prepared by reacting a hydrocarbyl substituted hydroxy alkylated amine with a molybdenum source as described in U.S. Pat. No. 4,164,473.

3. Compounds prepared by reacting a phenol aldehyde condensation product, a mono-alkylated alkylene diamine, and a molybdenum source as described in U.S. Pat. No. 4,266,945.

4. Compounds prepared by reacting a fatty oil, diethanolamine, and a molybdenum source as described in U.S. Pat. No. 4,889,647.

5. Compounds prepared by reacting a fatty oil or acid with 2-(2-aminoethyl)aminoethanol, and a molybdenum source as described in U.S. Pat. No. 5,137,647.

6. Compounds prepared by reacting a secondary amine with a molybdenum source as described in U.S. Pat. No. 4,692,256.

7. Compounds prepared by reacting a diol, diamino, or amino-alcohol compound with a molybdenum source as described in U.S. Pat. No. 5,412,130.

8. Compounds prepared by reacting a fatty oil, monoalkylated alkylene diamine, and a molybdenum source as described in U.S. Pat. No. 6,509,303.

9. Compounds prepared by reacting a fatty acid, monoalkylated alkylene diamine, glycerides, and a molybdenum source as described in U.S. Pat. No. 6,528,463.

Molybdenum compounds prepared by reacting a fatty oil, diethanolamine, and a molybdenum source as described in U.S. Pat. No. 4,889,647 are sometimes illustrated with the following structure, where R is a fatty alkyl chain, although the exact chemical composition of these materials is not fully known and may in fact be multi-component mixtures of several organomolybdenum compounds.

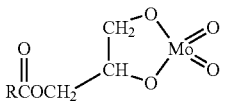

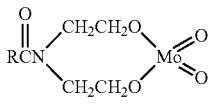

Sulfur-containing organomolybdenum compounds may be used and may be prepared by a variety of methods. One method involves reacting a sulfur and phosphorus-free molybdenum source with an amino group and one or more sulfur sources. Sulfur sources can include for example, but are not limited to, carbon disulfide, hydrogen sulfide, sodium sulfide and elemental sulfur. Alternatively, the sulfur-containing molybdenum compound may be prepared by reacting a sulfur-containing molybdenum source with an amino group or thiuram group and optionally a second sulfur source.

Examples of sulfur- and phosphorus-free molybdenum sources include molybdenum trioxide, ammonium molybdate, sodium molybdate, potassium molybdate, and molybdenum halides. The amino groups may be monoamines, diamines, or polyamines. As an example, the reaction of molybdenum trioxide with a secondary amine and carbon disulfide produces molybdenum dithiocarbamates. Alternatively, the reaction of $(NH_4)_2Mo_3S_{13}*n(H_2O)$ where n varies between 0 and 2, with a tetralkylthiuram disulfide, produces a trinuclear sulfur-containing molybdenum dithiocarbamate.

Examples of sulfur-containing organomolybdenum compounds appearing in patents and patent applications include the following:

1. Compounds prepared by reacting molybdenum trioxide with a secondary amine and carbon disulfide as described in U.S. Pat. Nos. 3,509,051 and 3,356,702.

2. Compounds prepared by reacting a sulfur-free molybdenum source with a secondary amine, carbon disulfide, and an additional sulfur source as described in U.S. Pat. No. 4,098,705.

3. Compounds prepared by reacting a molybdenum halide with a secondary amine and carbon disulfide as described in U.S. Pat. No. 4,178,258.

4. Compounds prepared by reacting a molybdenum source with a basic nitrogen compound and a sulfur source as described in U.S. Pat. Nos. 4,263,152, 4,265,773, 4,272,387, 4,285,822, 4,369,119, and 4,395,343.

5. Compounds prepared by reacting ammonium tetrathiomolybdate with a basic nitrogen compound as described in U.S. Pat. No. 4,283,295.

6. Compounds prepared by reacting an olefin, sulfur, an amine and a molybdenum source as described in U.S. Pat. No. 4,362,633.

7. Compounds prepared by reacting ammonium tetrathiomolybdate with a basic nitrogen compound and an organic sulfur source as described in U.S. Pat. No. 4,402,840.

8. Compounds prepared by reacting a phenolic compound, an amine and a molybdenum source with a sulfur source as described in U.S. Pat. No. 4,466,901.

9. Compounds prepared by reacting a triglyceride, a basic nitrogen compound, a molybdenum source, and a sulfur source as described in U.S. Pat. No. 4,765,918.

10. Compounds prepared by reacting alkali metal alkylthioxanthate salts with molybdenum halides as described in U.S. Pat. No. 4,966,719.

11. Compounds prepared by reacting a tetralkylthiuram disulfide with molybdenum hexacarbonyl as described in U.S. Pat. No. 4,978,464.

12. Compounds prepared by reacting an alkyl dixanthogen with molybdenum hexacarbonyl as described in U.S. Pat. No. 4,990,271.

13. Compounds prepared by reacting alkali metal alkylxanthate salts with dimolybdenum tetra-acetate as described in U.S. Pat. No. 4,995,996.

14. Compounds prepared by reacting $(NH_4)_2Mo_3S_{13}*2H_2O$ with an alkali metal dialkyldithiocarbamate or tetralkyl thiuram disulfide as described in U.S. Pat. No. 6,232,276.

15. Compounds prepared by reacting an ester or acid with a diamine, a molybdenum source and carbon disulfide as described in U.S. Pat. No. 6,103,674.

16. Compounds prepared by reacting an alkali metal dialkyldithiocarbamate with 3-chloropropionic acid, followed by molybdenum trioxide, as described in U.S. Pat. No. 6,117,826.

Molybdenum dithiocarbamates may be illustrated by the following structure,

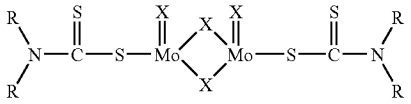

where R is an alkyl group containing 4 to 18 carbons or H, and X is O or S.

Glycerides may also be used alone or in combination with other friction modifiers. Suitable glycerides include glycerides of the formula:

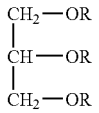

wherein each R is independently selected from the group consisting of H and C(O)R' where R' may be a saturated or an unsaturated alkyl group having from 3 to 23 carbon atoms. Examples of glycerides that may be used include glycerol monolaurate, glycerol monomyristate, glycerol monopalmitate, glycerol monostearate, and monoglycerides derived from coconut acid, tallow acid, oleic acid, linoleic acid, and linolenic acids. Typical commercial monoglycerides contain substantial amounts of the corresponding diglycerides and triglycerides. These materials are not detrimental to the production of the molybdenum compounds, and may in fact be more active. Any ratio of mono- to di-glyceride may be used, however, it is preferred that from 30 to 70% of the available sites contain free hydroxyl groups (i.e., 30 to 70% of the total R groups of the glycerides represented by the above formula are hydrogen). A preferred glyceride is glycerol monooleate, which is generally a mixture of mono, di, and tri-glycerides derived from oleic acid, and glycerol.

Additional Additives

Rust inhibitors selected from the group consisting of nonionic polyoxyalkylene polyols and esters thereof, polyoxyalkylene phenols, and anionic alkyl sulfonic acids may be used.

A small amount of a demulsifying component may be used. A preferred demulsifying component is described in EP 330,522. Such demulsifying component may be obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

Seal swell agents, as described, for example, in U.S. Pat. Nos. 3,794,081 and 4,029,587, may also be used.

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Functionalized olefin copolymers that may be used include interpolymers of ethylene and propylene which are grafted with an active monomer such as maleic anhydride and then derivatized with an alcohol or amine. Other such copolymers are copolymers of ethylene and propylene which are grafted with nitrogen compounds.

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 10% by weight based on the weight of the lubricating oil composition.

The components described herein may be added directly to the lubricating oil composition. In one embodiment, however, they are diluted with a substantially inert, normally liquid organic diluent such as mineral oil, synthetic oil, naphtha, alkylated (e.g. $C_{10}$ to $C_{13}$ alkyl) benzene, toluene or xylene to form an additive concentrate. These concentrates usually contain from about 1% to about 100% by weight and in one embodiment about 10% to about 90% by weight of the components.

Base Oils

Base oils suitable for use in formulating the compositions, additives and concentrates described herein may be selected from any of the synthetic or natural oils or mixtures thereof. The synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like. The synthetic oils may also include the gas to liquid synthetic oils.

Natural base oils include animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. The base oil typically has a viscosity of about 2.5 to about 15 cSt and preferably about 2.5 to about 11 cSt at 100° C.

The following examples are given for the purpose of exemplifying aspects of the embodiments and are not intended to limit the embodiments in any way.

EXAMPLE 3

Boundary Friction Coefficients of Oil-Soluble Components

In the following example, a base oil (EXXON EHC45) can be added to a component containing one or more diblock monopolymer components solubilized in tetrahydrofuran (THF) until 70 wt. % of the solution was the base oil so that the concentration of components in the base oil is about 0.07 weight percent. Boundary friction coefficients of component solutions containing different size components can be measured in a high frequency reciprocating test rig (HFRR) at a temperature of 30° C. A 30/70 wt. % mixture of THF and the base oil can also be examined as a control.

The results will indicate that the components are effective to reduce friction under pure sliding conditions.

In order to measure the boundary friction of oils containing each component at a temperature more relevant to the condition commonly used to study the boundary friction of engine oils or other lubricants, one weight percent solutions of the components can be suspended in a Group II base oil. The boundary friction coefficients for the component/Base oil (such as EXXON EHC45) solutions can then be measured at 100° C. The results will show that the components reduced friction relative to a base oil having an absence of the components.

It is expected that formulations containing from about 0.5 to about 1.0 wt. % or more oil-soluble components will enable a reduction in the amount of conventional phosphorus and sulfur antiwear agents needed thereby improving the performance of pollution control equipment on vehicles while achieving a similar or improved friction coefficient performance or benefit and little or no adverse effect on the corrosiveness of the oil.

At numerous places throughout this specification has been made to a number of U.S. patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A method for reducing a friction coefficient adjacent a lubricated surface, comprising providing an amount of an oil-soluble or oil-dispersible component comprising a material selected from the group consisting of a photo-crosslinkable poly(2-cinnamoyloxyalkyl acrylate) core and a diblock acrylate copolymer corona in a fully formulated lubricant composition containing a base oil of lubricating viscosity, and applying the lubricant composition containing the component to a surface to be lubricated.

2. The method of claim 1, wherein the lubricated surface comprises an engine drive train.

3. The method of claim 1, wherein the lubricated surface comprises an internal surface or component of an internal combustion engine.

4. The method of claim 1, wherein the lubricated surface comprises an internal surface or component of a compression ignition engine.

5. The method of claim 1, wherein the amount of oil-soluble or oil-dispersible component in the fully formulated lubricant composition ranges up to about 5 percent by weight.

6. The method of claim 1, wherein the amount of oil-soluble or oil-dispersible component in the fully formulated lubricant composition ranges from about 0.1 to about 5 percent by weight.

7. The method of claim 1, wherein the amount of oil-soluble or oil-dispersible component in the fully formulated lubricant composition ranges from about 0.5 to about 2 percent by weight.

8. A method of reducing a friction coefficient of an engine lubricant composition during operation of an engine containing the lubricant composition, comprising contacting the engine parts with a fully formulated lubricant composition comprising a base oil of lubricating viscosity and an amount of an oil-soluble or oil-dispersible component selected from the group consisting of a photo-crosslinkable poly(2-cinnamoyloxyalkyl acrylate) core and a diblock acrylate copolymer corona sufficient to reduce the friction coefficient to below a friction coefficient of a lubricant composition devoid of the oil-soluble or oil-dispersible component.

9. The method of claim 8 wherein the engine comprises a heavy duty diesel engine.

10. The method of claim 8, wherein the amount of component in the fully formulated lubricant composition ranges up to about 5 percent by weight.

11. The method of claim 8, wherein the amount of component in the fully formulated lubricant composition ranges from about 0.5 to about 2 percent by weight.

12. A method of for reducing wear between moving parts using a lubricating oil, the method comprising using as the lubricating oil for one or more moving parts a lubricant composition containing a base oil, and an oil additive package including a wear reducing agent, wherein the wear reducing agent comprises a component selected from the group consisting of a photo-crosslinkable poly(2-cinnamoyloxyalkyl acrylate) core and a diblock acrylate copolymer corona.

13. The method of claim 12, wherein the moving parts comprise moving parts of an engine.

14. The method of claim 12, wherein the engine is selected from the group consisting of a compression ignition engine and a spark ignition engine.

15. The method of claim 12, wherein the engine includes an internal combustion engine having a crankcase and wherein the lubricating oil comprises a crankcase oil present in the crankcase of the engine.

16. The method of claim 12, wherein the lubricating oil comprises a drive train lubricant present in a drive train of a vehicle containing the engine.

17. The method of claim 12, wherein the wear reducing agent is present in the lubricant composition in an amount ranging up to about 5 percent by weight.

18. The method of claim 12, wherein the wear reducing agent is present in the lubricant composition in an amount ranging from about 0.1 to about 5 percent by weight.

19. The method of claim 12, wherein the wear reducing agent is present in the lubricant composition in an amount ranging from about 0.5 to about 2 percent by weight.

20. A method for reducing a friction coefficient adjacent a lubricated surface, comprising providing an amount of an oil-soluble or oil-dispersible component comprising a material selected from the group consisting of a photo-crosslinkable poly(2-cinnamoyloxyalkyl acrylate) core and a diblock acrylate copolymer corona in a fully formulated lubricant composition containing a base oil of lubricating viscosity, and applying the lubricant composition containing the component to a surface to be lubricated, wherein the component has a core diameter greater than the film thickness of the lubricant composition.

21. A method of reducing a friction coefficient of an engine lubricant composition during operation of an engine containing the lubricant composition, comprising contacting the engine parts with a fully formulated lubricant composition comprising a base oil of lubricating viscosity and an amount of an oil-soluble or oil-dispersible component selected from the group consisting of a photo-crosslinkable poly(2-cinnamoyloxyalkyl acrylate) core and a diblock acrylate copolymer corona sufficient to reduce the friction coefficient to below a friction coefficient of a lubricant composition devoid of the component, wherein the component has a core diameter greater than the film thickness of the lubricant composition.

22. A method for reducing a friction coefficient adjacent a lubricated surface, comprising providing an amount of oil-soluble or oil-dispersible diblock polymers having a first block and a second block in a fully formulated lubricant composition containing a base oil of lubricating viscosity, and applying the lubricant composition containing the diblock polymers to a surface to be lubricated.

23. The method of claim 22, wherein said first block is a photo-crosslinkable poly(2-cinnamoyloxyalkyl acrylate) core and said second block is an oil-soluble diblock acrylate copolymer corona.

24. The method of claim 22, wherein said first block is selected from the group consisting essentially of poly[2-cinnamoyloxyethyl acrylate, poly[2-cinnamoyloxyethyl acrylate)-ran-(2-octtanoyloxethyl acrylate)], and combinations thereof.

25. The method of claim 22, wherein said first block and second block undergo a chemical reaction to form micelles.

26. The method of claim 22, wherein the lubricated surface comprises an engine drive train.

27. The method of claim 22, wherein the lubricated surface comprises an internal surface or component of an internal combustion engine.

28. The method of claim 22, wherein the lubricated surface comprises an internal surface or component of a compression ignition engine.

29. The method of claim 22, wherein the amount of oil-soluble or oil-dispersible diblock polymer component in the fully formulated lubricant composition ranges up to about 5 percent by weight.

30. The method of claim 22, wherein the amount of oil-soluble or oil-dispersible diblock polymer component in the fully formulated lubricant composition ranges from about 0.1 to about 5 percent by weight.

31. The method of claim 22, wherein the amount of oil-soluble or oil-dispersible diblock polymer component in the fully formulated lubricant composition ranges from about 0.5 to about 2 percent by weight.

32. A method of reducing a friction coefficient of an engine lubricant composition during operation of an engine containing the lubricant composition, comprising contacting the engine parts with a fully formulated lubricant composition comprising a base oil of lubricating viscosity and an amount of an oil-soluble or oil-dispersible diblock polymer component derived from a photo-crosslinkable poly(2-cinnamoyloxyalkyl acrylate) core and a diblock acrylate copolymer corona sufficient to reduce the friction coefficient to below a friction coefficient of a lubricant composition devoid of the oil-soluble or oil-dispersible diblock polymer component.

33. The method of claim 32, wherein the engine comprises a heavy duty diesel engine.

34. The method of claim 32, wherein the amount of oil-soluble or oil-dispersible diblock polymer component in the fully formulated lubricant composition ranges up to about 5 percent by weight.

35. The method of claim 32, wherein the amount of oil-soluble or oil-dispersible diblock polymer component in the fully formulated lubricant composition ranges from about 0.5 to about 2 percent by weight.

36. A method of for reducing wear between moving parts using a lubricating oil, the method comprising using as the lubricating oil for one or more moving parts a lubricant composition containing a base oil, and an oil additive package including a wear reducing agent, wherein the wear reducing agent comprises an oil-soluble or oil-dispersible diblock polymer component derived from a photo-crosslinkable poly (2-cinnamoyloxyalkyl acrylate) core and a diblock acrylate copolymer corona.

37. The method of claim 36, wherein the moving parts comprise moving parts of an engine.

38. The method of claim 37, wherein the engine is selected from the group consisting of a compression ignition engine and a spark ignition engine.

39. The method of claim 37, wherein the engine includes an internal combustion engine having a crankcase and wherein the lubricating oil comprises a crankcase oil present in the crankcase of the engine.

40. The method of claim 37, wherein the lubricating oil comprises a drive train lubricant present in a drive train of a vehicle containing the engine.

41. The method of claim 36, wherein the wear reducing agent is present in the lubricant composition in an amount ranging up to about 5 percent by weight.

42. The method of claim 36, wherein the wear reducing agent is present in the lubricant composition in an amount ranging from about 0.1 to about 5 percent by weight.

43. The method of claim 36, wherein the wear reducing agent is present in the lubricant composition in an amount ranging from about 0.5 to about 2 percent by weight.

44. A method for reducing a friction coefficient adjacent a lubricated surface, comprising providing an amount of an oil-soluble or oil-dispersible diblock polymer component derived from a photo-crosslinkable poly(2-cinnamoyloxyalkyl acrylate) core and a diblock acrylate copolymer corona in a fully formulated lubricant composition containing a base oil of lubricating viscosity, and applying the lubricant composition containing the diblock polymer component to a surface to be lubricated, wherein the diblock polymer component has a core diameter greater than the film thickness of the lubricant composition.

45. A method of reducing a friction coefficient of an engine lubricant composition during operation of an engine containing the lubricant composition, comprising contacting the engine parts with a fully formulated lubricant composition comprising a base oil of lubricating viscosity and an amount of an oil-soluble or oil-dispersible diblock polymer component derived from a photo-crosslinkable poly(2-cinnamoyloxyalkyl acrylate) core and a diblock acrylate copolymer corona sufficient to reduce the friction coefficient to below a friction coefficient of a lubricant composition devoid of the oil-soluble or oil-dispersible diblock polymer component, wherein the diblock polymer component has a core diameter greater than the film thickness of the lubricant composition.

46. A fully formulated lubricant composition comprising:

an oil-soluble or oil-dispersible diblock polymer component having a first block and a second block; and a base oil of lubricating viscosity.

47. The composition of claim 46, wherein said first block is a photo-crosslinkable poly(2-cinnamoyloxyalkyl acrylate) core and said second block is an oil-soluble diblock acrylate copolymer corona.

48. The composition of claim 46, wherein said lubricant composition containing said diblock polymer component provides for a reduction in wear between moving parts which is below the amount of wear in a lubricant composition devoid of said diblock polymer component.

49. The composition of claim 46, wherein said diblock polymer component is present in an amount sufficient to reduce the friction coefficient adjacent a lubricated surface below a friction coefficient of a lubricant composition devoid of the oil-soluble or oil-dispersible diblock polymer component.

50. The composition of claim 46, wherein said diblock polymer component is present in an amount sufficient to reduce the friction coefficient of an engine lubricant composition below the friction coefficient of an engine lubricant composition devoid of the oil-soluble or oil-dispersible diblock polymer component.

51. A method for imparting friction modification or wear reduction properties to a lubricating oil, comprising:

combining a lubricating oil with a component selected from the group consisting of a photo-crosslinkable poly (2-cinnamoyloxyalkyl acrylate) core and a diblock acrylate copolymer corona, wherein the lubricating oil is selected from the group consisting of engine oil, gear oil, automatic transmission fluids, manual transmission fluids, hydraulic oil, metal-working fluids, and industrial oil.

52. A fully formulated lubricant composition comprising:

(a) an oil-soluble or oil-dispersible component selected from the group consisting of a photo-crosslinkable poly (2-cinnamoyloxyalkyl acrylate) core and a diblock acrylate copolymer corona; and (b) a base oil of lubricating viscosity.

* * * * *